US010857475B2

(12) United States Patent
Moskowitz

(10) Patent No.: US 10,857,475 B2
(45) Date of Patent: Dec. 8, 2020

(54) MAGNETIC TILES CONSTRUCTION SET AND ACCESSORIES KIT THEREFOR

(71) Applicant: Max Moskowitz, Kew Garden Hills, NY (US)

(72) Inventor: Max Moskowitz, Kew Garden Hills, NY (US)

( * ) Notice: Subject to any disclaimer, the term of this patent is extended or adjusted under 35 U.S.C. 154(b) by 651 days.

(21) Appl. No.: 15/255,267

(22) Filed: Sep. 2, 2016

(65) Prior Publication Data

US 2017/0065899 A1 Mar. 9, 2017

Related U.S. Application Data

(60) Provisional application No. 62/344,138, filed on Jun. 1, 2016, provisional application No. 62/213,943, filed on Sep. 3, 2015.

(51) Int. Cl.
*A63H 33/04* (2006.01)
*A63H 33/10* (2006.01)

(52) U.S. Cl.
CPC ..... *A63H 33/046* (2013.01); *A63H 33/044* (2013.01); *A63H 33/103* (2013.01); *A63H 33/108* (2013.01)

(58) Field of Classification Search
CPC ..... A63H 33/04; A63H 33/046; A63H 33/12
See application file for complete search history.

(56) References Cited

U.S. PATENT DOCUMENTS 1,935,542 A * 11/1933 Bursell ..... A63H 3/52 446/110
2,132,647 A * 10/1938 Robins ..... A63H 33/108 446/94
2,245,875 A * 6/1941 Rutherford ..... A63F 9/088 273/155
2,795,893 A * 6/1957 Vayo ..... A63H 33/046 446/92
2,983,071 A * 5/1961 Oliver ..... A63H 33/108 446/92
3,530,614 A * 9/1970 Strongin ..... A63H 33/065 446/487
3,955,307 A * 5/1976 Payton ..... A63H 3/52 446/92
3,998,004 A * 12/1976 Ehrlich ..... A63H 33/046 446/92
4,095,366 A * 6/1978 Buck ..... A63F 9/088 446/487
4,177,305 A * 12/1979 Feingold ..... B44C 3/123 273/157 R (Continued)

*Primary Examiner* — Eugene L Kim
*Assistant Examiner* — Alyssa M Hylinski
(74) *Attorney, Agent, or Firm* — Ostrolenk Faber LLP

(57) ABSTRACT

A game set allows building wall structures with magnetic tiles that have magnets located around the peripheral sides or edges. Since the tiles are held only by magnetic force, they are susceptible to buckling by application of perpendicular forces and to prevent such buckling, a plurality of thin holding strips are provided that extend over the joint, magnetically held edges of the magnetic tiles and prevents buckling. The magnet set also includes additional accessories, such as figurines that can be magnetically adhered to the wall structures, electrical lighting that can be adhered to the wall structures and drawing sheets that can be adhered to the wall structures.

12 Claims, 11 Drawing Sheets

(56) References Cited

U.S. PATENT DOCUMENTS 4,504,243 A * 3/1985 Barlow ..... A63F 3/00634 446/444
4,569,527 A * 2/1986 Rosenwinkel ..... A63F 3/00145 273/251
4,635,410 A * 1/1987 Chumbley ..... B44C 7/022 160/378
4,986,756 A * 1/1991 Yamaguchi ..... A63F 9/06 273/157 R
5,024,611 A * 6/1991 Eckerle ..... A63H 3/50 273/285
5,158,295 A * 10/1992 Shilling ..... A63F 9/1044 273/157 R
5,265,885 A * 11/1993 Blount ..... A63F 9/34 273/239
5,342,048 A * 8/1994 Jones ..... A63F 9/143 446/444
5,378,187 A * 1/1995 Forbes ..... A63H 3/50 248/224.8
5,553,849 A * 9/1996 Slone ..... A63F 3/00694 273/239
5,623,801 A * 4/1997 Drumbl ..... E04F 19/08 248/206.5
5,628,670 A * 5/1997 Hill ..... A63F 9/088 446/487
5,707,269 A * 1/1998 Murphy ..... A63H 33/048 446/268
5,733,166 A * 3/1998 Hoag ..... A63H 3/00 40/735
5,746,430 A * 5/1998 Chester ..... A63F 9/1044 273/157 R
6,093,079 A * 7/2000 House ..... A63H 18/02 238/10 E
6,113,454 A * 9/2000 Mitchell ..... A63H 33/00 446/227
6,179,685 B1 * 1/2001 Toft ..... A63H 3/52 446/128
6,328,500 B1 * 12/2001 Rubio ..... A63C 19/00 104/55
6,427,926 B1 * 8/2002 Lai ..... A63H 18/02 104/53
6,431,936 B1 * 8/2002 Kiribuchi ..... A63H 33/046 446/129
6,443,796 B1 * 9/2002 Shackelford ..... A63H 33/042 273/237
6,761,563 B1 * 7/2004 Lin ..... G09B 5/062 273/153 R
7,047,576 B2 * 5/2006 Tavivian ..... A47K 3/30 16/225
7,154,363 B2 * 12/2006 Hunts ..... H01F 7/0242 335/306
7,354,040 B2 * 4/2008 Schneider ..... A63F 3/00 273/239
7,470,166 B2 * 12/2008 Allen ..... A63H 18/00 446/108
7,690,963 B2 * 4/2010 Whitehead ..... A63H 33/26 446/129
8,038,502 B2 * 10/2011 Loetz ..... A63H 3/00 446/118
8,187,006 B2 * 5/2012 Rudisill ..... H01R 11/30 362/249.06
8,210,892 B2 * 7/2012 Thrush ..... A63F 9/1288 446/108
9,022,829 B2 * 5/2015 Rosen ..... A63H 33/046 446/108
9,022,832 B1 * 5/2015 Skripps ..... A63H 3/48 446/330
9,311,836 B1 * 4/2016 van der Walde ... G09F 15/0006
9,669,324 B2 * 6/2017 Roth ..... A63H 33/062
2002/0006763 A1 * 1/2002 Forbes ..... A63F 9/0666 446/1
2002/0098774 A1 * 7/2002 Huang ..... A63H 33/00 446/487
2003/0047872 A1 * 3/2003 Lawrence ..... A63F 3/00697 273/276
2005/0075035 A1 * 4/2005 Hatting ..... A63H 33/101 446/85
2005/0253336 A1 * 11/2005 Schwartz ..... A63F 9/0613 273/157 R
2006/0111010 A1 * 5/2006 Park ..... A63H 33/046 446/92
2007/0010164 A1 * 1/2007 Kowalski ..... A63H 33/26 446/485
2007/0054589 A1 * 3/2007 Loetz ..... A63H 3/50 446/139
2008/0314427 A1 * 12/2008 Lai ..... A63H 33/008 135/96
2009/0288283 A1 * 11/2009 Fullerton ..... A63H 33/046 29/428
2010/0117298 A1 * 5/2010 Grey ..... A63F 9/06 273/239
2010/0227529 A1 * 9/2010 Riley ..... A63F 9/088 446/487
2010/0321937 A1 * 12/2010 Van Bommel ..... F21S 2/005 362/235
2012/0224373 A1 * 9/2012 Snijder ..... F21S 2/005 362/249.01
2013/0111710 A1 * 5/2013 Hunts ..... H01F 7/0242 24/303
2014/0099159 A1 * 4/2014 Maunder ..... F16B 5/0024 403/294
2014/0227934 A1 * 8/2014 Rudisill ..... A63H 33/046 446/92
2014/0256210 A1 * 9/2014 Johnson ..... A63H 33/046 446/108
2014/0302741 A1 * 10/2014 Whittaker ..... A63H 33/046 446/92
2014/0327209 A1 * 11/2014 Mizanoski ..... A63F 3/0423 273/272
2015/0072587 A1 * 3/2015 Ornstein ..... A63H 33/046 446/92
2015/0231521 A1 * 8/2015 Peterson ..... A63H 33/046 446/92
2015/0265937 A1 * 9/2015 Chen ..... A63H 33/008 472/136
2015/0367247 A1 * 12/2015 Kosmo ..... A63H 33/42 446/71
2016/0074766 A1 * 3/2016 Choi ..... A63H 33/046 446/92
2016/0243436 A1 * 8/2016 Minor ..... A63F 9/20

* cited by examiner

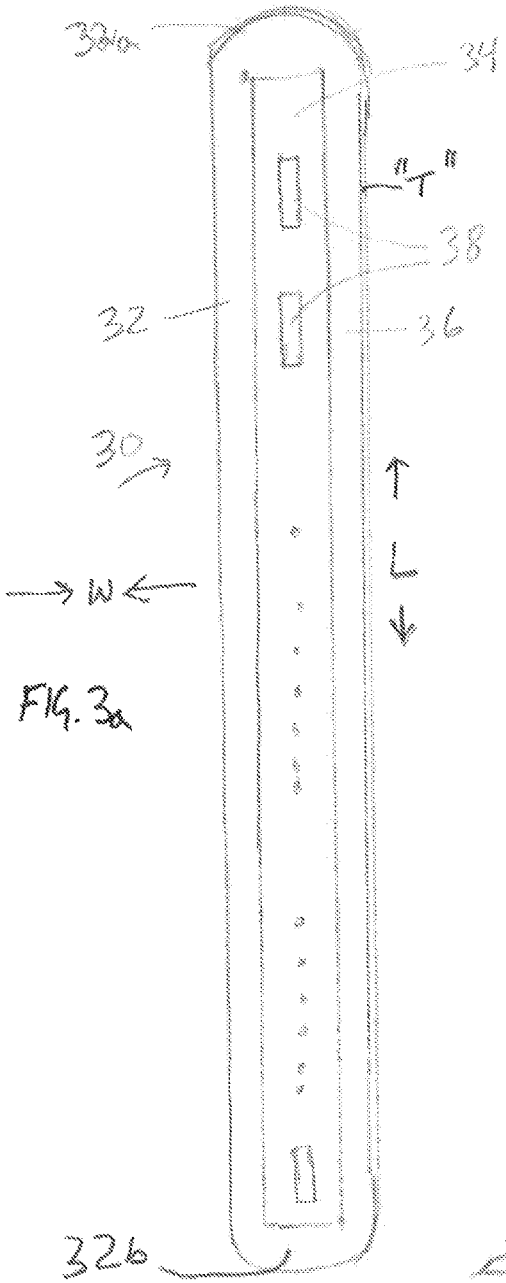
FIG. 3a
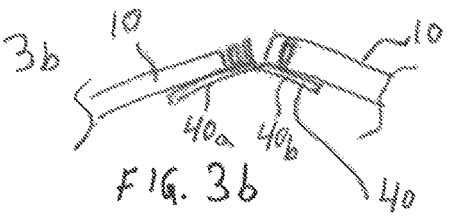
FIG. 3b
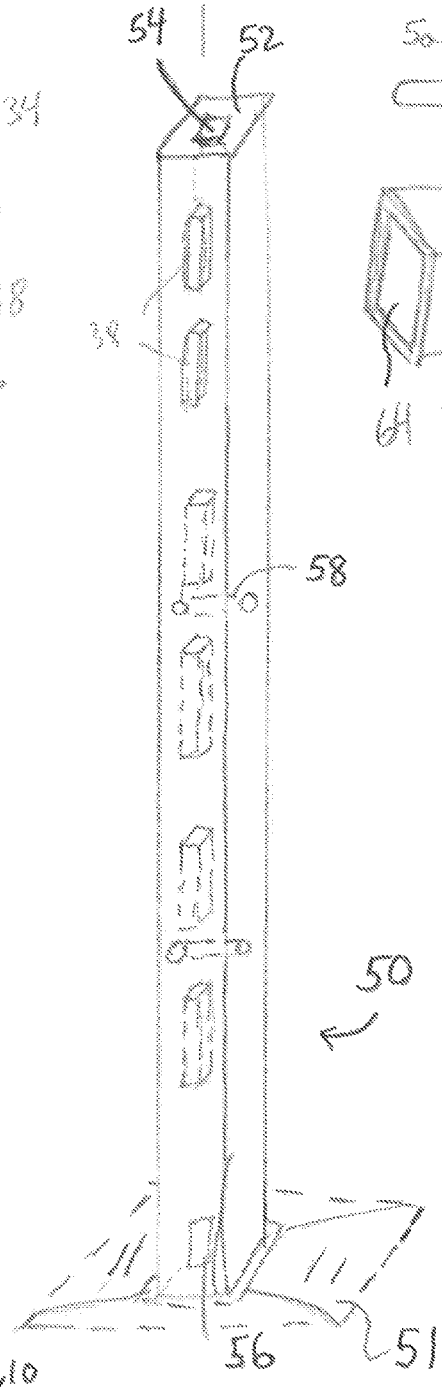
FIG. 4
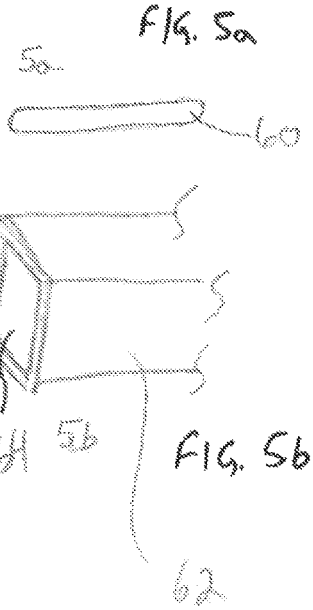
FIG. 5a
FIG. 5b
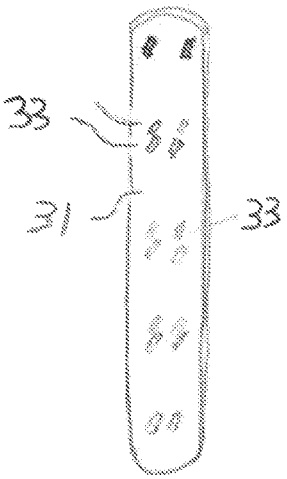
FIG. 3c FIG. 8
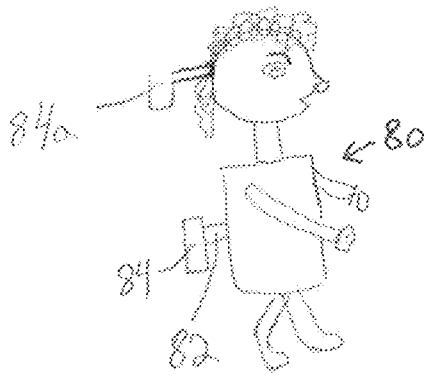
FIG. 8a
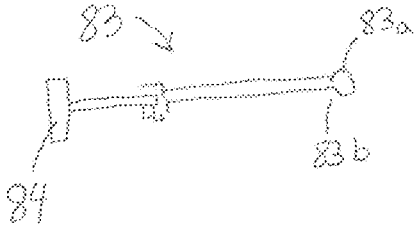
FIG. 12
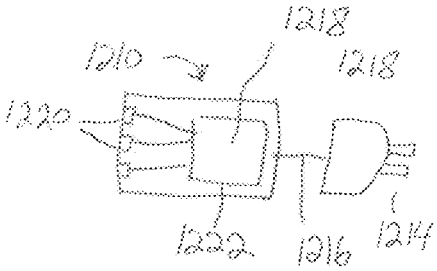
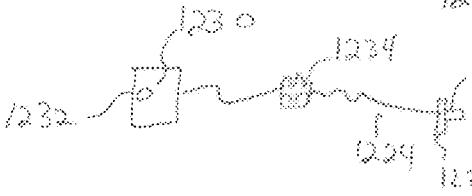
FIG. 12a
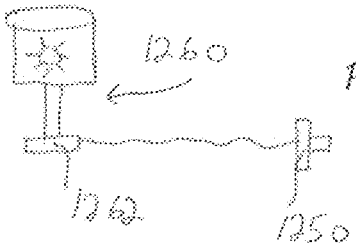
FIG. 12e
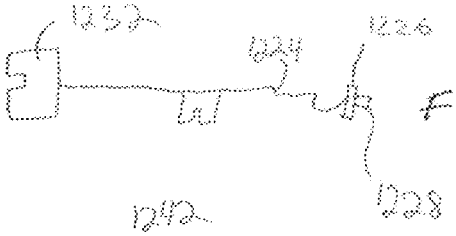
FIG. 12b
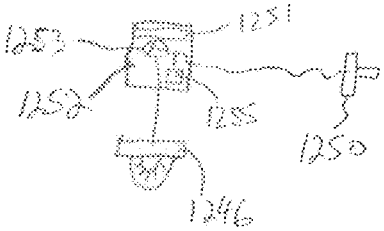
FIG. 12d
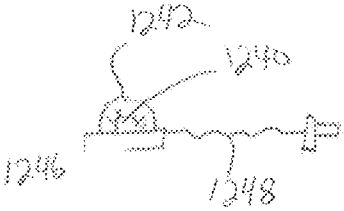
FIG. 12c

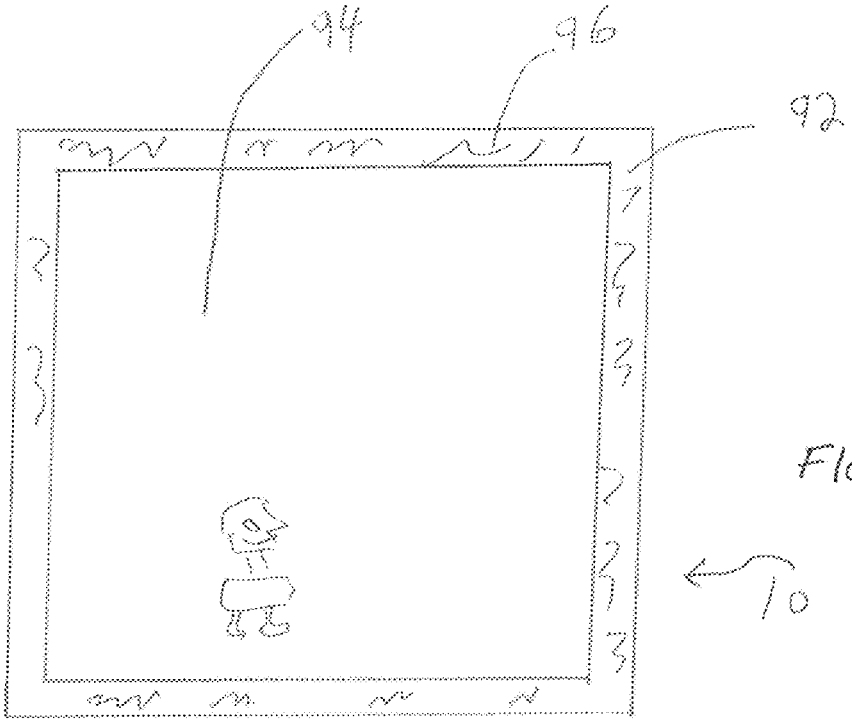
FIG. 9
FIG. 10
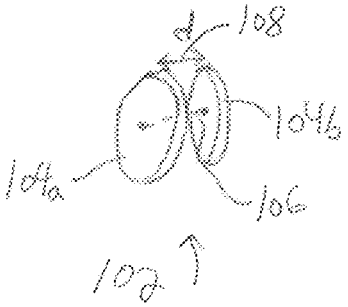
FIG. 11a
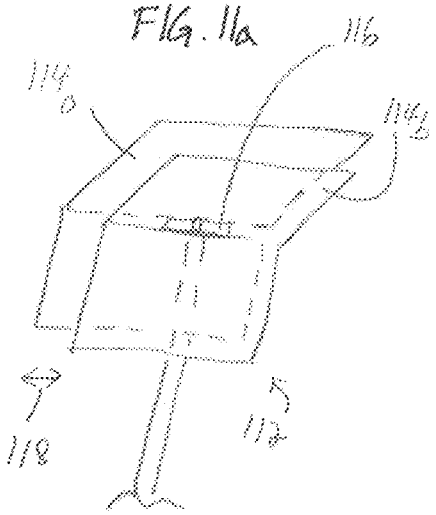
FIG. 11b
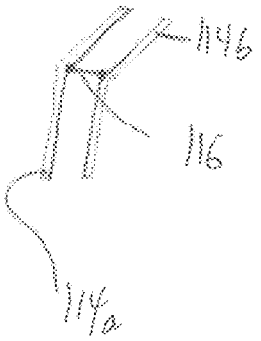

MAGNETIC TILES CONSTRUCTION SET AND ACCESSORIES KIT THEREFOR

CROSS REFERENCE OF THE RELATED APPLICATION(S)

This present application claims benefit of and priority to U.S. Provisional Application No. 62/344,138 filed on Jun. 1, 2016 and U.S. Provisional Application No. 62/213,943 filed on Sep. 3, 2015, both entitled "MAGNETIC TILES CONSTRUCTION SET AND ACCESSORIES KIT THEREFOR," the entire contents of which are both hereby incorporated by reference.

BACKGROUND OF THE INVENTION

The present invention relates to construction games, and more particularly, to a construction game using magnetic tiles with pairs of magnets along the tile edges or sides.

The tiles to which the present invention pertains were invented in 1992 by a Japanese math teacher to teach children about shapes, square, rectangular, triangular, etc., through play.

Nowadays, these tiles come in standard sizes and several companies have been selling them in the United States for many years and children have become very fond of playing with these tiles to construct very elaborate structures, such as houses, towers and the like, using the various shapes of magnetic tiles. One basic size of the tile is the square-shaped tile measuring 7.5 cm on each side, with a thickness of about 7 mm. The tiles also come in triangular shapes and other shapes and in larger sizes; for example, a single tile four times the area of the basic 7.5 cm size. These tiles are typically constructed by having two plastic plates spaced apart with spacers of 7 mm, to create spaces in between and along the sides for accommodating a pair of magnets at each side, in well-known manner. At the four corners are four rivets that hold the structure together.

U.S. patent publication 2014/0227934 describes features for such a tile. Background information is also provided in U.S. Pat. Nos. D713,891; 2,872,754; 3,254,440; 3,998,004; 5,021,021; 5,411,262; 6,017,220; 6,024,626; 6,431,936; 6,969,294; 7,154,363; 7,160,170; and 7,988,518. Also providing background information is patent publication no. 2010/0056013. The entire contents of the aforementioned United States patents and patent publications are incorporated by reference herein.

One of the troubling and quite annoying drawbacks of playing with these widely popular magnetic tiles is that when one erects tall walls by arranging the tiles vertically and horizontally, they are very susceptible to buckling along their horizontal and vertical magnetically held joint lines. Another drawback is the inability to erect horizontal or leaning suspended structures. Another drawback of the prior art magnetic tile game is that tiles slide relative to each other due to gravity when suspended.

SUMMARY OF THE INVENTION

The primary objective of the present invention is to ameliorate the problems of buckling and inability to construct leaning or suspended walls. The secondary objective of the present invention is to provide various additional accessories and features that enhance the pleasure of playing with the magnetic tiles.

In accordance with preferred embodiments the invention comprises a game set including a plurality of construction pieces, the construction pieces contain either one or more magnets or ferromagnetic material to enable the construction pieces to adhere to each other magnetically, the game set comprising: a plurality of magnetic tiles where each magnetic tile has three or more peripherally extending peripheral sides and a respective thickness substantially smaller than a respective length of the peripheral sides, and each of the magnetic tiles has one or more magnets embedded therein adjacent the peripheral sides thereof, the magnetic tiles being configured to adhere magnetically to each other at their peripheral sides; and a plurality of thin, holding strips constructed at least in part of ferromagnetic material, the holding strips having respective length and width dimensions and respective thickness dimensions, the thickness dimension being less than 2 millimeters and the length dimension being sufficiently long to enable the holding strip to extend over and magnetically adhere to more than at least two, adjoining pairs of the magnetic tiles that lie in a common plane, by being placed over magnetically joined edges of the pairs of the magnetic tiles and the width of the holding strips being sufficient to resist forces at the joined edges of the magnetic tiles that tend to bend the tiles away from the common plane of the joined pairs of magnetic tiles.

Preferably, the holding strips have lengths sufficient to extend over the joined edges of at least four of the pairs of the magnetic tiles, and the holding strips are constructed so they can extend in vertical or horizontal directions over a vertical wall constructed of the magnetic tiles. Preferably, the game set includes a plurality of figurines that have a connection structure containing either magnets or ferromagnetic material and constructed so as to enable the figurines to be magnetically secured to the magnetic tiles, and the magnetic tiles include embedded magnets, at a location thereof away from the peripheral sides of the magnetic tiles, to which the figurines are configured can be magnetically attached, and the location has a recess where the connection structure of the figurines can be received inside the recess, to prevent downward sliding of the figurines. Preferably, the game set includes vertically extending roof supporting beams for being placed within a chamber formed with the magnetic tiles, to support a roof structure over the chamber, and at least one angled holding strip comprising two or more of said holding strips with a bent bracket between them that configures the angled holding strip to extend bent in two planes, to enable constructing a contiguous wall of magnetic tiles, having a vertical section and an inclined section that is non-vertical and which extends from a top edge of the vertical wall section, and the magnetic tiles include, at corner regions thereof, through going eyelets into which a thin pin is insertable, and the holding strips contain fingers that fit within the eyelets of the magnetic tiles to provide additional sturdiness to wall structures made of the magnetic tiles, via the holding strips.

Preferably, the game set includes a plurality of electrical lights that are configured to be attached to wall structures formed of the magnetic tiles and to be magnetically held to the wall structures, and a drawing sheet that comprises a thin drawing surface surrounded by a border and is large enough to be placed over a tile wall comprising a 2×2 matrix of tiles, the drawing sheet being magnetically attachable to the tile wall and being configured to allow a player to draw on said drawing surface.

Other features and advantages of the present invention will become apparent from the following description of the invention which refers to the accompanying drawings.

BRIEF DESCRIPTION OF THE DRAWINGS

FIG. 3*a* shows a strip, made of very thin metallic plate for ameliorating the buckling problem.

FIGS. 3*b*, 3*c* and 3*d* show variations of the anti-buckling plate of FIG. 3*a*.

FIG. 4 shows a support post to enable creating various vertical, horizontal and leaning frames, to which the magnetic tiles can be fitted/attached.

FIG. 5*a* shows a peg for connecting two of the posts of FIG. 4 to each other.

FIG. 5*b* shows a connecting sleeve for the connecting posts of FIG. 4.

FIG. 8 shows an example of a figurine accessory, with a metallic, ferromagnetic bead attached via an arm to the figurine for attaching to the center magnet of FIG. 7.

FIG. 8*a* shows a separately provided holding arm for the figurines of FIG. 8.

FIG. 9 is a drawing with a border containing metallic, ferromagnetic material so that it can be easily attached to any tile or to several tiles to decorate a structure made of the magnetic tiles.

FIG. 10 shows a two-plate tile connector configured to be located at a joint point of four tiles to prevent tile buckling.

FIG. 11*a* shows a variation of the anti-buckling plates of FIG. 10.

FIG. 11*b* is an end view of FIG. 11*a*.

FIG. 12 shows an electrical system for developing a low voltage to drive LED lights configured for use with the tiles of the present invention.

FIGS. 12*a* and 12*b* shows lengthy, thin, preferably magnetic, electrical cables for conducting low voltage electrical power from the low voltage power supply of FIG. 12.

FIG. 12*c* shows an LED lamp with a metallic base that is magnetically attached to the center of a tile, to light up an interior structure made from the magnetic tiles.

FIG. 12*d* shows a hanging lamp.

FIG. 12*e* shows an upright lamp with an interior LED.

DETAILED DESCRIPTION OF EMBODIMENTS OF THE INVENTION

Figure 1A:
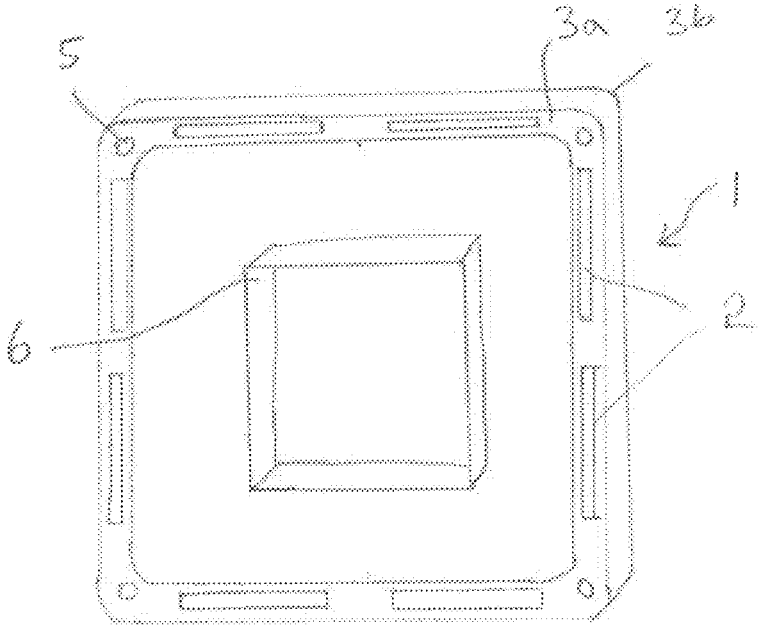
FIG. 1a (PRIOR ART)
FIG. 1*a* depicts a standard magnetic tile.

FIG. 1*a* depicts a conventional magnetic tile with magnets around the edges, two at each side, with a front wall and a rear wall 3*a*, 3*b* spaced apart to create a thickness 4 and the walls held to each other with rivets 5 at the four corners. At the center is a reinforcing structure 6 so that the tile would keep its flat shape.

Figure 2A:
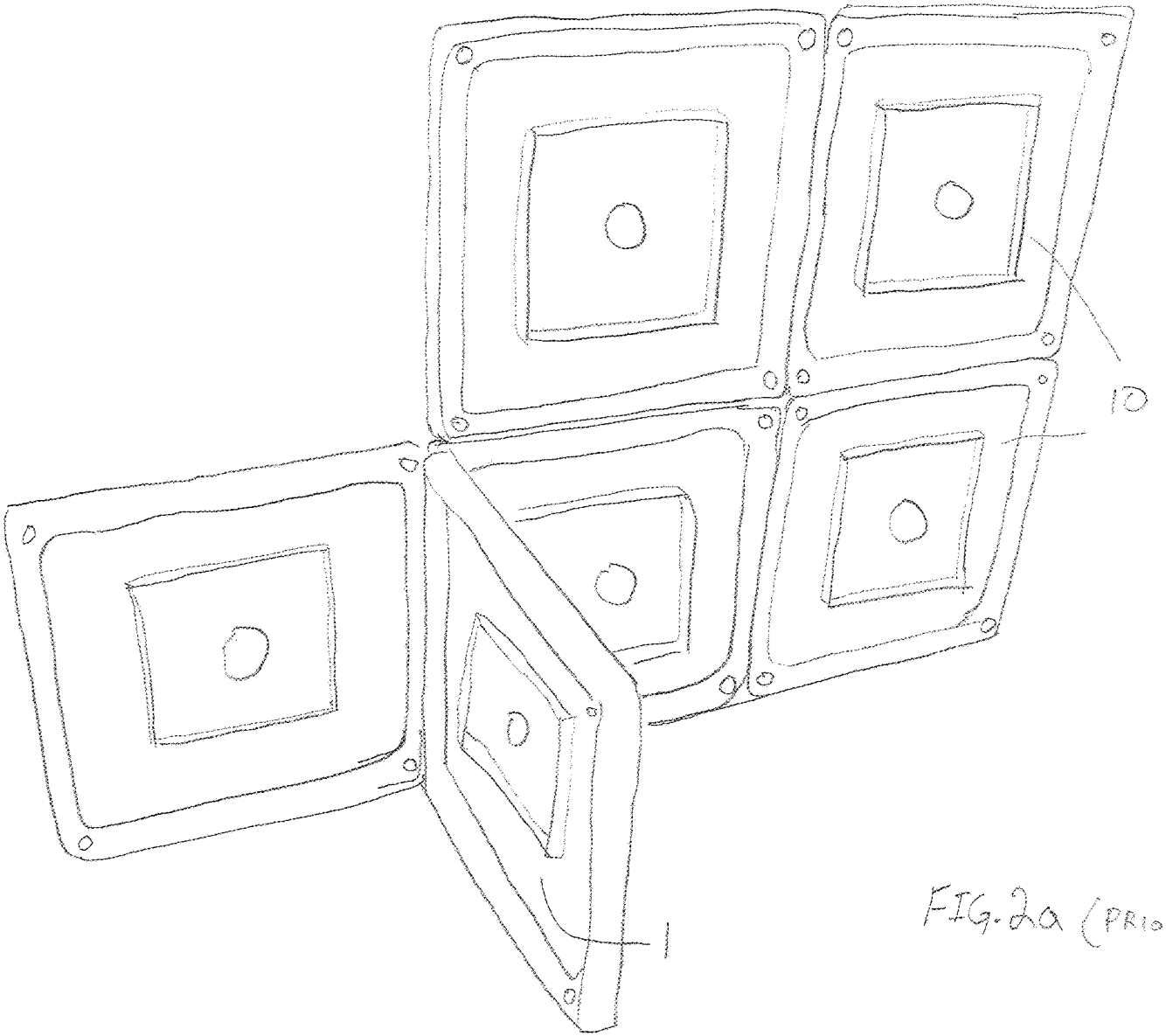
FIG. 2a (PRIOR ART)
FIG. 2*a* shows the tile of FIG. 1*b*, utilized to construct a wall structure.

With reference to FIG. 2*a*, a collection of the tiles 1 of FIG. 1*a* are utilized to create a wall structure having three of the tiles oriented in a row and two of the tiles on top of the first row and one of the tiles at an angle to the other tiles. In the tiles of the present invention, in order to see inside the tile structure, e.g., a home, preferably not only the walls at the edges, but even at the center are made of transparent material for various effects including, as described further on.

Figure 2B:
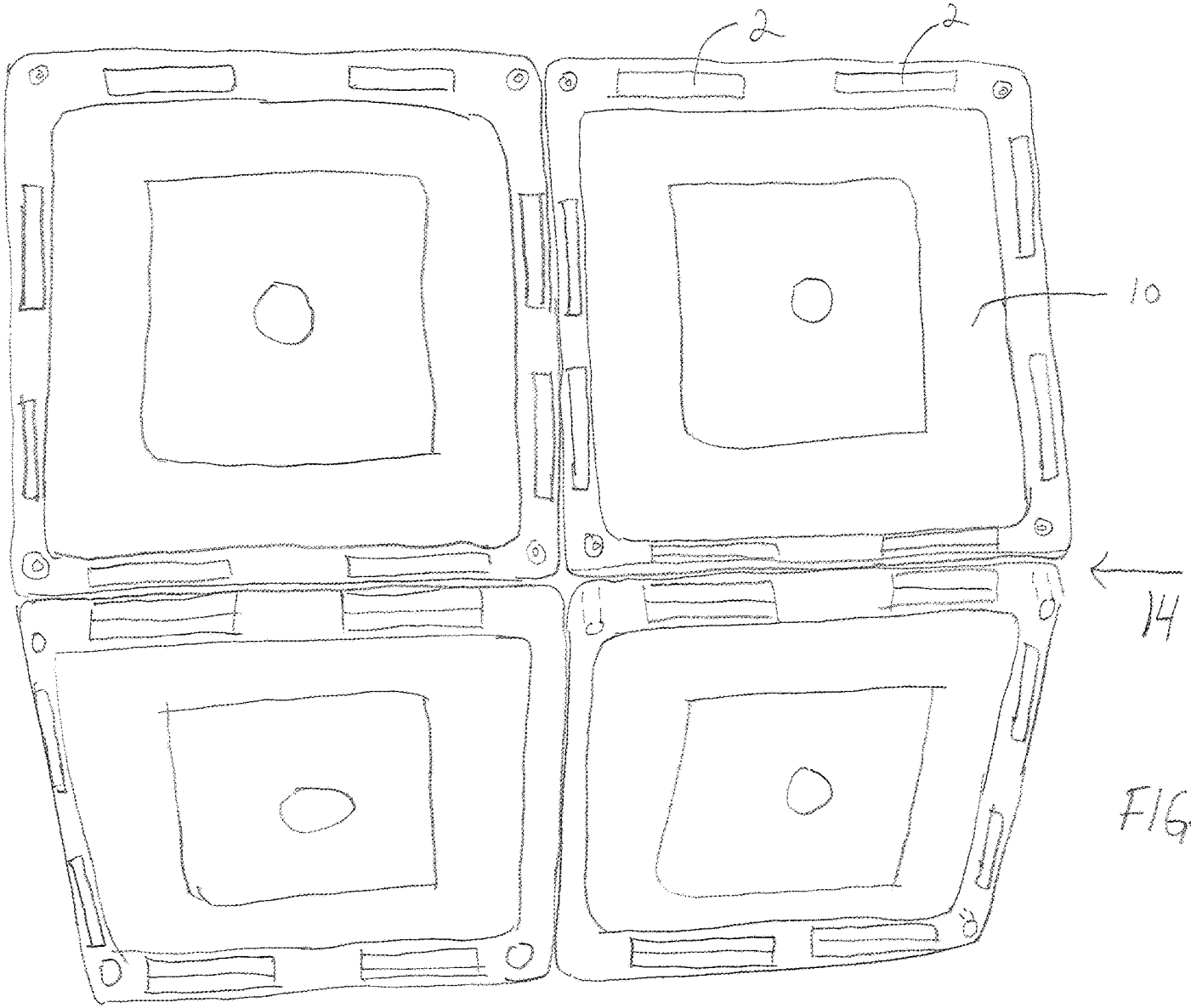
FIG. 2*b* exemplifies the buckling problem associated with the tiles of the present invention.

Referring to FIG. 2*b*, a serious impediment to the enjoyment of the game derives from the fact that at the joint line indicated by the arrow 14, it is very easy to apply a lateral force directed into the page and easily buckle the entire structure, because the magnets' main strength is holding the tiles vertically or in a line relative to each other without any holding ability against bending or sliding.

To solve the aforementioned drawback of the magnetic tile construction game, FIG. 3*a* illustrates a metallic strip 30 made of ferromagnetic material, for example, sheet metal, which has a length, width and thickness as indicated. Preferably, the thickness is not more than 2 mm and, preferably in a size between 0.2 mm to 2 mm, preferably 0.4 to 0.6 mm and most preferably about 0.5 mm. The length is substantially larger, for example, about 20 cm and still more preferably, just a shade under several tile lengths. The strip 30 helps stabilize a column of, say, three, four or five or even a greater number of the tiles, where each tile has the standard size of 7½ cm.

The metallic strip is made of a ferromagnetic material, for example, sheet metal, so it is drawn to the magnets in the tile. It is also flat, very thin and rigid to hold several magnetic tiles straight in the same plane. The thinness is preferably about or even less than one-half of one millimeter. In experiments, a sheet metal strip has been successful in stabilizing an entire structure from buckling, as well as enabling construction of roof structures over distances spanning several tiles, without the tiles buckling and collapsing and bringing down the entire structure. The metallic body 32 preferably has straight edges along the length, while its distal ends 32*a*, 32*b* are rounded for safety. Obviously, in a typical game set, the player is provided with many of these strips, and they may come in many different lengths, to provide for variety of play. Also, long strips may have a width-wise extending bend, so a top section of the strip e.g. the top one third portion, is bent from the vertical at an angle, for example, 30° (but any angle is possible). These strips enable elaborate tile constructions, including with leaning wall sections, roofs and the like.

In accordance with a preferred embodiment, the metallic strip is actually comprised of a center metallic strip 34 that is encased in an extremely thin, transparent and rigid plastic body with sides 36 that extend beyond the centerpiece 34. For example, the width of the centerpiece may be about 10 mm, while the total width with the transparent and rigid plastic comes closer to 20 mm that reduces the weight of the piece. The pieces shown in FIG. 3*a* can come in many different lengths. However, the width thereof should be standardized as noted above.

In a further embodiment of the invention, the strip can have attached thereto at one side, which is located away from the tiles' magnets 38 that are similar to those found in the tiles. Regardless, even without the magnets 38, a tile placed on the side of the strip 30, at right angle to the strip, will still be adhered to the overall structure. This can be seen in FIG. 6*c*, where the tile 60*a* which touches the strip 30 is still magnetically attracted to the overall structure, because the thickness of the strip, as noted, is only about one half millimeter, preferably 0.4 mm.

However, to create a frame or an internal structure within outer walls created from the tiles, reference is made to FIG.

4, which shows a post or beam 50 preferably having a rectangular or square cross-section 52 and also, in accordance with an option of the invention, magnets 38 dispersed there along, as shown. The post 50, owing to its structure, can stand upright or it may be supported (removably) in a post base 51. The post length can be extended via openings 54, 56 and 58 that can be circular or rectangular to enable extending the post length by attaching to it another post. To this end, a peg 60 shown in FIG. 5*a*, which may be square or round, can be attached to both posts so that they stand on one another without buckling. To provide greater assurance against the post buckling, the sleeve 62 having an opening 64 matching exactly the outer shape of the post 50 is provided and it can be slipped over the post at the point where two posts are joined with one another. A post can also be oriented horizontally by using the peg 60 at the opening 58 which can be provided at several locations on the post 50. By placing the post in the middle of a tile structure, a child or adult can create structures inside that do not necessarily reach the outer walls of the tile structure and may also create an overall frame to which the tiles can be attached. The combination of the posts 50 with the strips 30 can also easily support roof structures and the like.

In FIG. 3*b*, is illustrated a variation of the strip 30, whereby the strip has two sections 40*a*, 40*b* at an angle to each other, for example, 20° or 30° and the like, so that wall structures can be erected from the tiles 10 that are at an angle to each other and to, for example, provide a closed structure that is generally polygonal or essentially round, like a turret or a silo and the like.

The metallic strip in FIG. 3*c* is provided with a plurality of jutting fingers or pins 33 that are precisely sized and spaced so that they can fit in the holes or eyelets 11 in the rivets 5 of a typical tile 10. See FIG. 1*b*. These rivets are typically spaced 6.8 cm apart and about 8 mm apart in adjacent tiles. Therefore, the cluster of four fingers 33 are spaced 8 mm apart and the clusters are themselves spaced apart by the distance between rivets in a same tile. The diameters of these fingers should be on the order of about 1 mm and they should extend approximately 4 mm in length, whereby when the strip is applied to a stack of magnetic tiles, the fingers 33 penetrate into the rivets and provide additional reinforcement of the structure. Naturally, the length of the fingers can be slightly larger, with a maximum of 7 mm, which represents the thickness of the tile or the depth of the hole in the rivet. The fingers may be threaded, so that a stemmed nut could be threaded thereon from the other side of the rivet hole, securely fastening the strip to the tile.

Figure 3D:
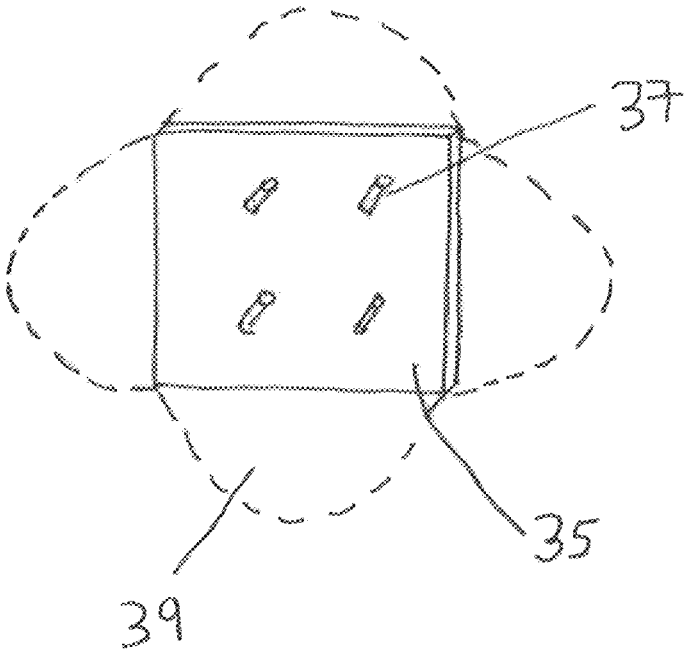

The tile reinforcer 35 in FIG. 3*d* is very similar, except that it is much smaller and it contains its respective set of four fingers 37, which will reinforce and hold together four tiles that adjoin each other. The optional four extension walls 39 enlarge the size of the reinforcer 35 and makes it large enough so that it would be safe against a child swallowing that piece, and also providing additional rigidity to the structure.

Figure 3E:
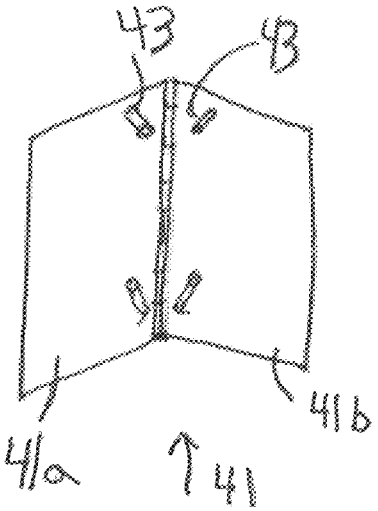
FIG. 3*e* shows a hinge accessory.

FIG. 3*e* illustrates another accessory, namely a hinge 41 that has hinge plates 41*a*, 41*b* hingedly joined, with the same fingers 43 as described above. When the hinge is placed against adjacent tiles, it allows one of the tiles to pivot, like a door or a window, providing for added joy and versatility when playing with the construction set of the invention.

Figure 6A:
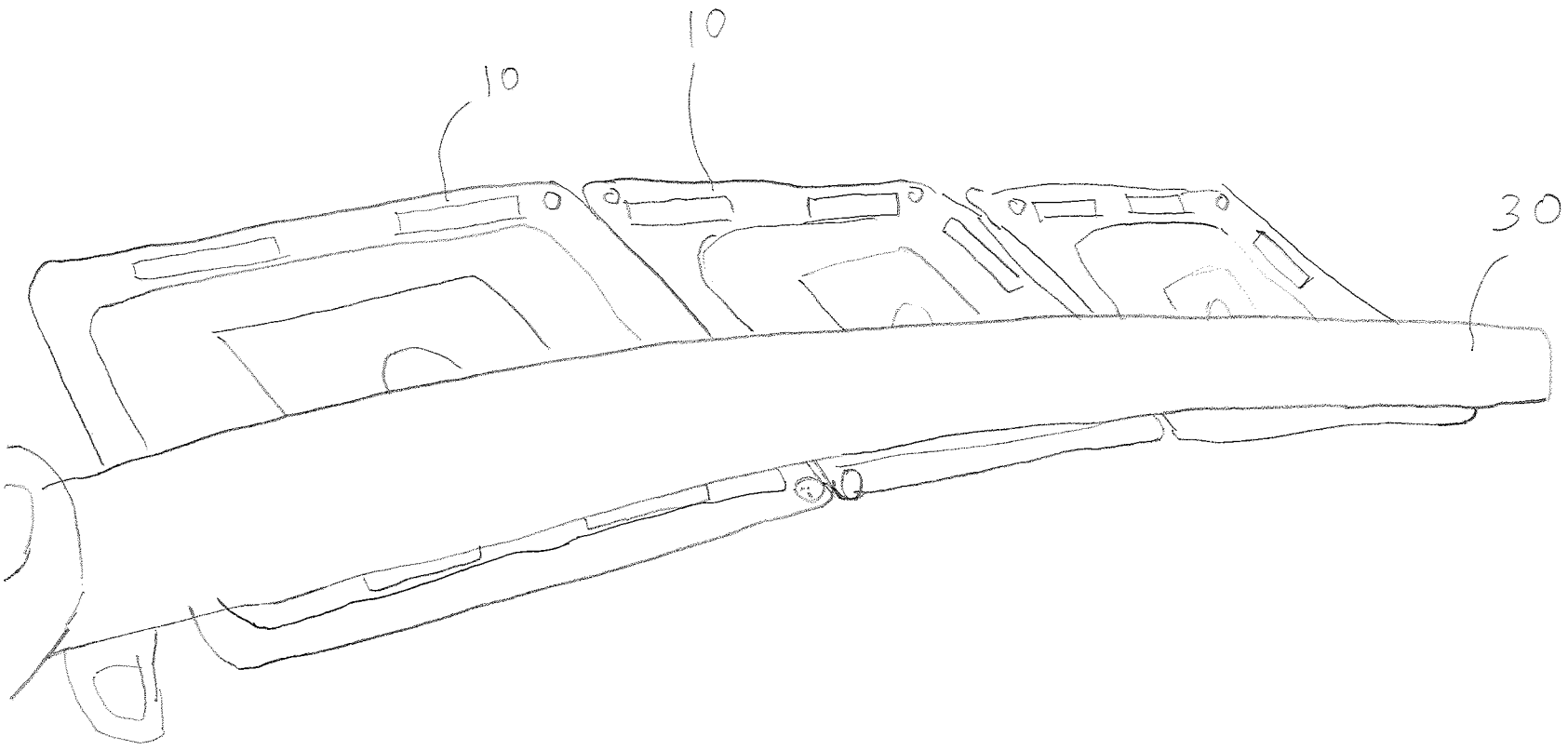
FIG. 6*a* shows an example of a metallic strip as in FIG. 3*a* used to support several magnetic tiles.
Figure 6B:
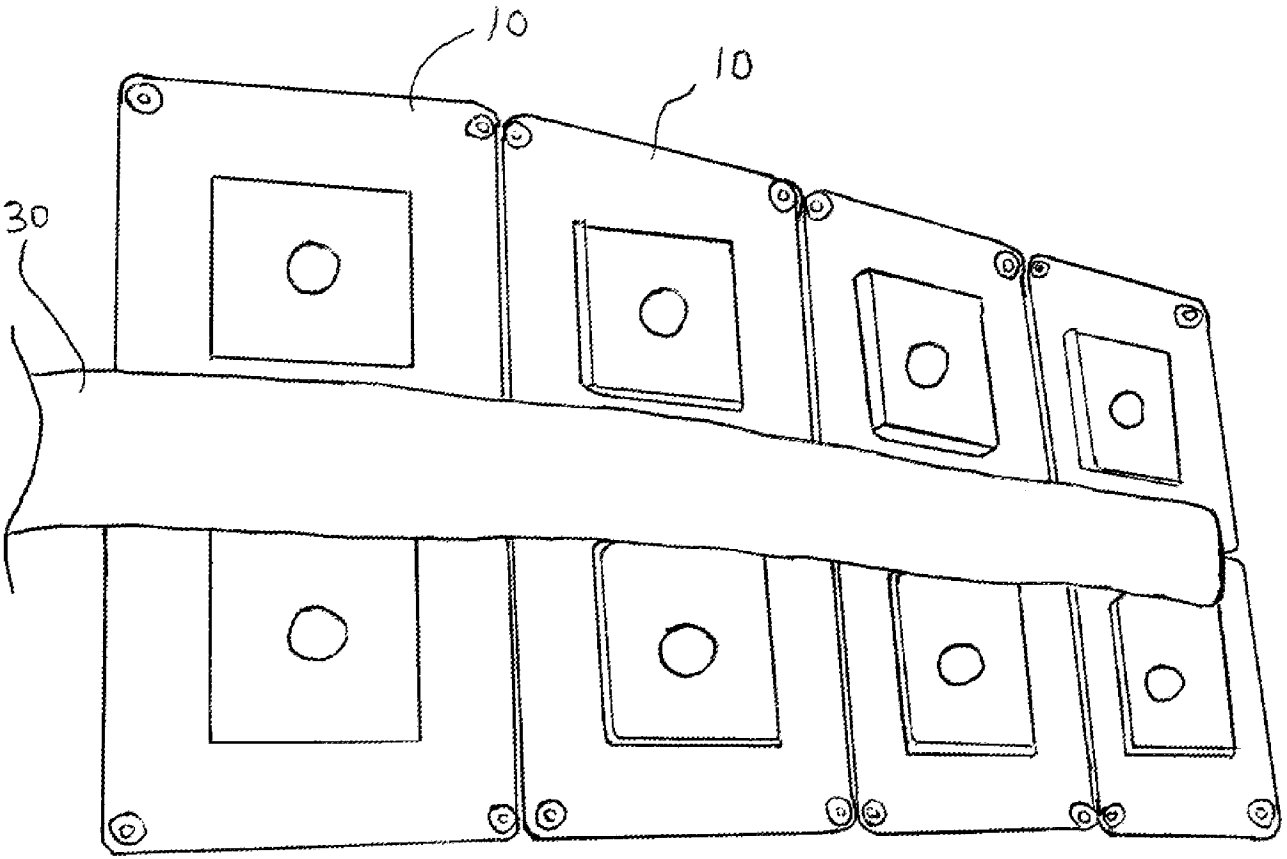
FIG. 6*b* is similar to FIG. 6*a*, showing supporting rows of tiles with the metal strip.
Figure 6C:
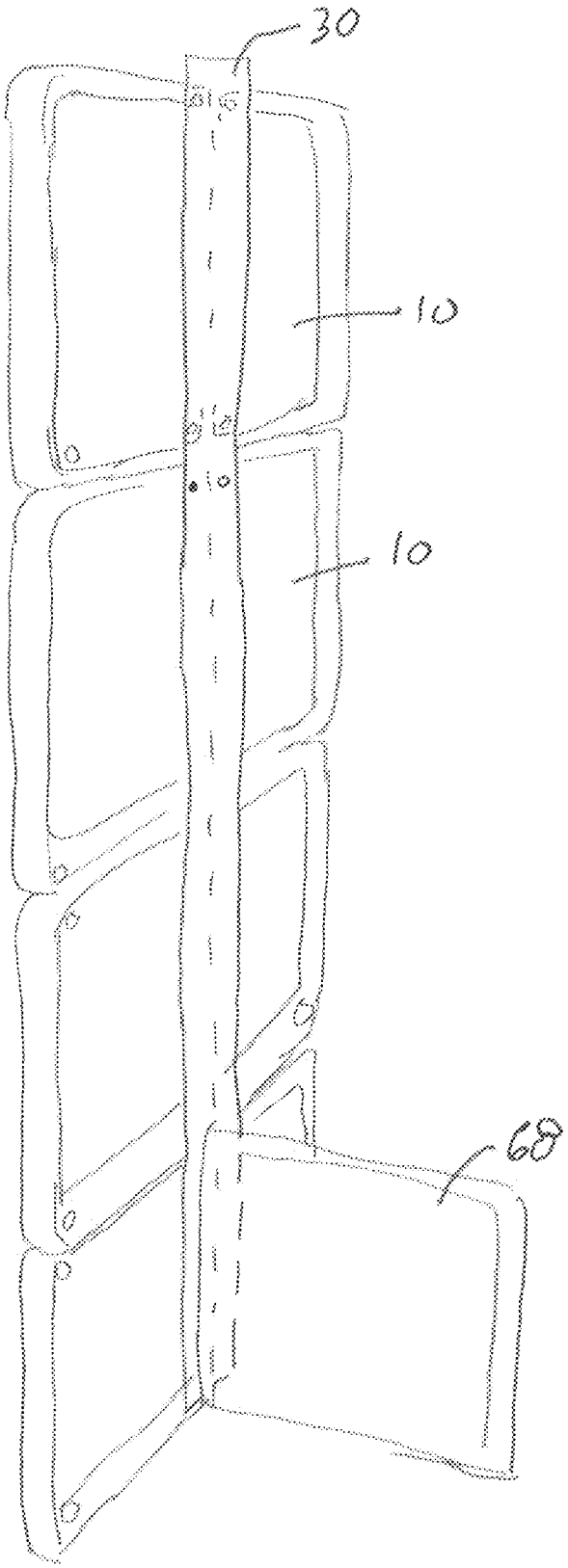
FIG. 6*c* shows the metal strip supporting vertically stacked tiles without buckling.

Referring to FIGS. 6*a*, 6*b*, and 6*c*, one can see that the use of the metal strip 30 allows holding many tiles in a horizontal orientation suspended in mid-air, for example, four tiles which will not buckle away and hold the structure. This makes for very interesting play, because one can create horizontal structures. In FIG. 6*b*, the strip is located underneath eight tiles and held only at the strip end, again illustrating the great utility of the strip. FIG. 6*c* also shows a strip 30 supporting many tiles in a vertical orientation with one tile 68 perpendicular to the others and still adhered, even with the magnetic force acting through the small gap of less than ½ mm of the strip. FIG. 6*e* shows the ability to raise an entire structure holding only onto the strip which is very helpful.

Figure 6D:
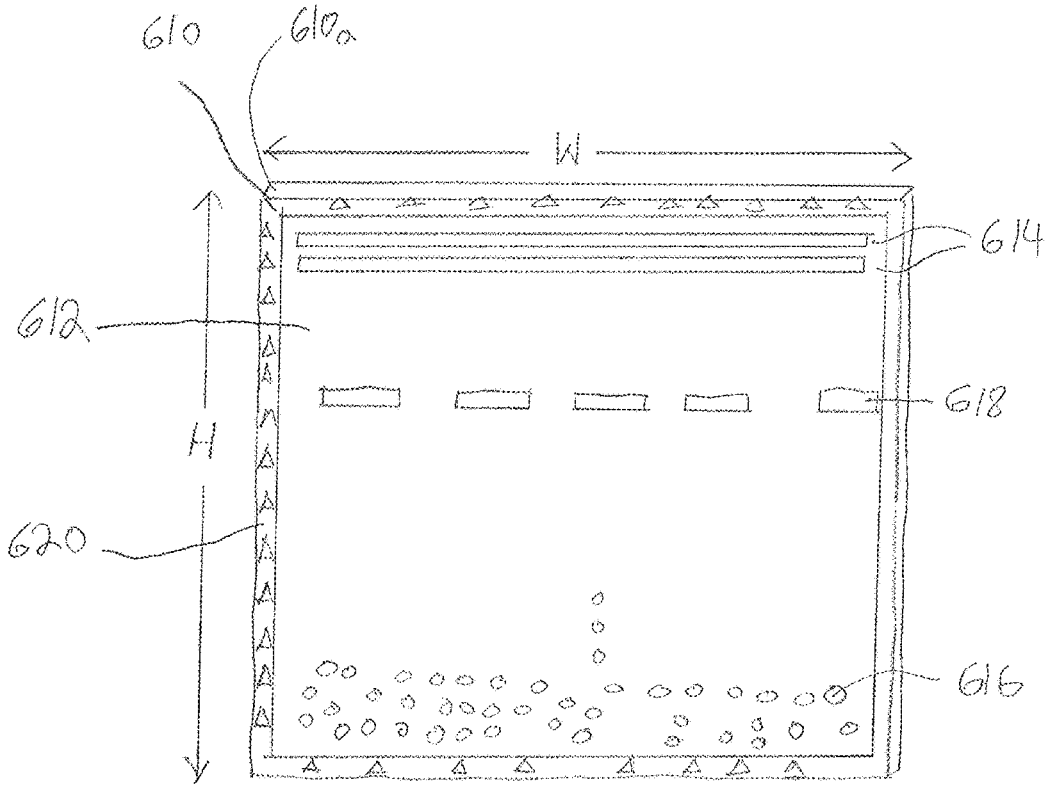
FIGS. 6*d* and 6*e* show further accessories for supporting wall sections of magnetic tiles.
Figure 6E:
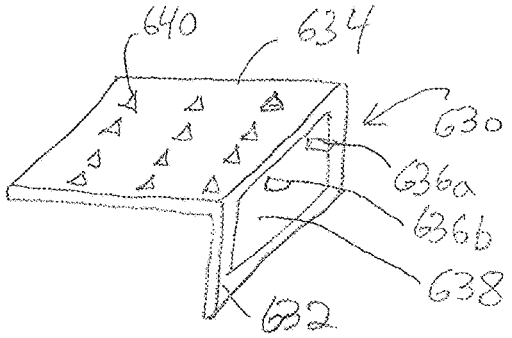

Referring to FIGS. 6*d* and 6*e*, the instant inventor also contemplates the use of a large, plastic sheet 610 made of a sturdy plastic material, for example of which clamshell containers are made, and which can be fabricated of either polystyrene, polyester, PVC and the like, which material is somewhat rigid but at the same time also flexible.

Most importantly, the sheet 610 can be square or rectangular with the width W and a height H measuring on the order of about 3 of the magnetic tiles or about 22 mm on one of the sides. The other side may also be 22 mm. On the other hand, the sheet can be 50% longer or even double the size mentioned. Importantly, the thickness of the plastic sheet is on the order of about 1 half millimeter to about 1 millimeter in thickness and is preferably made of transparent plastic. One side of the sheet 610 is coated, in accordance with one embodiment herein, with a ferromagnetic layer of sufficient thickness so that the tiles 1 will adhere strongly to the sheet, thereby preventing the tiles 1 from buckling. For example, for a sheet 610 measuring 22×22 mm, a matrix of 3×3 of the aforementioned magnetic tiles 1 could be accommodated and supported against buckling.

It would be immediately apparent to one skilled in the art, that these sheets 610 will support a standing wall of tiles 1 and it would be further apparent that two sheets 610 can be partially overlapped, for example to create larger spans of wall sections of the tiles 1. Because the sheets 610 are very thin, they can be overlapped to create any wall size. For example, two sheets 610 can be overlapped to create a wall measuring 22 mm on one side and anywhere from 22 to 40 mm (assuming a 4 mm overlap) on the other side.

In FIG. 6*d*, a layer 612 of ferromagnetic material can cover most of the interior area of one side of the sheet 610. However, in accordance with further embodiments, the ferromagnetic layer can be formed as a plurality of strips 614 of ferromagnetic material or, alternatively, as small spaced sections 618 of ferromagnetic material or even as small circles or even mixtures of the aforementioned, in order to obtain a sheet 610 that remains transparent, particularly when using the circles of ferromagnetic material 616. Effectively, the sheet 610 (or several of them when combined) acts as a tile wall reinforcement that is placed inside the tile structure, against the wall being built. Because of its flexibility and thinness, preferably approximately 0.5 to 0.75 mm and owing to its transparency, the sheet does not distract from the outside appearance of the magnetic tile structure being erected. As another option, the kit of the invention includes large sheets, one side of which has painted thereon a metallic paint (or the metallic paint may be laminated between to outer sheets), and the user can cut strips from it to attach to and support a large structure of magnetic tiles, including a roof structure. Or, the ferro-magnetic sheet can be provided in long lengths, even several feet, e.g. in a roll, and strips cut from it.

In conjunction with the bracket 630 (FIG. 6*e*), the sheets 610 can be used to support a roof structure made of magnetic tiles 1. To this end, the sheet material 610 is provided around its border with hook-and-loop material 620. The "L" bracket 630 which can be made of ferromagnetic metal, e.g. steel, is attached to a tile wall structure on the inside surface thereof adjacent to where the roof structure would be erected. More specifically, the bracket 630 has an upright 632 and a horizontal extension 634. The upright 632 with its pins 636*a* and 636*b* is placed against the tile, so that the projection 636*a*, 636*b* fit into the aforementioned corner holes in the tiles 1. The horizontal extension 634 extends into the structure space creating a ledge for a roof structure to be supported thereon. When the sheet 610 is placed in an orientation whereby its Velcro border 620 engages the corresponding Velcro 640 on the extension 634, it will sag somewhat but will not fall. Thereafter, the tiles 1 can be placed on top of the sheet 610 to create a roof structure for the enjoyment of a child and most certainly for adults as well.

When PVC is used to make the sheet 610, it is made of polyvinyl chloride, preferably the rigid type, sometimes referred to as RPVC, which is both rigid and flexible. However pure polyvinyl chloride may be also used which has the disadvantage that it is more solid but at the same time also brittle. Alternatively, the material of the sheets 610 can be opaque plastic or cardboard material, or any strong, but thin material.

Figure 7:
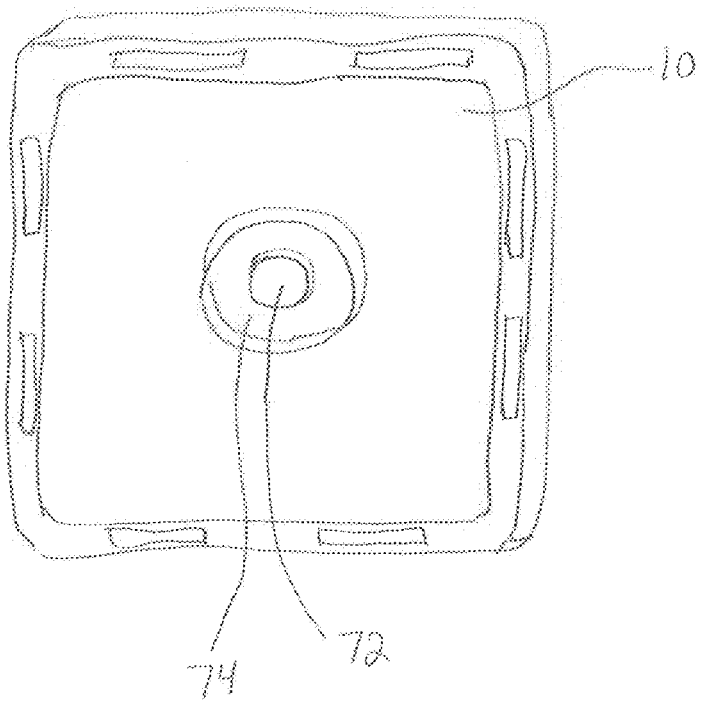
FIG. 7 shows a conventional tile with a center magnet located in a recess of the tile, for supporting an accessory.

Referring to FIG. 7, an otherwise conventional magnetic plane tile 10 is provided, in accordance with an embodiment of the invention, with a centrally located magnet 72 that is sandwiched between the outer walls of the magnetic tile 10, with the front wall having a recess or indentation 74 which is depicted to be circular, but might also be constructed in another geometric shape; for example, square or rectangular, for a purpose that is elucidated by referring to FIG. 8.

Thus, in accordance with a preferred embodiment of the invention, the tile construction set includes various figurines, for example, a child figurine 80, which is a three-dimensional child figurine that is outfitted with an extension 82 to which is attached a ferromagnetic bead 84 which has a peripheral shape that matches the peripheral shape of the recess 74 in FIG. 7 and which is made of either a magnetic material, but preferably just a metallic, ferromagnetic material. When the figurine 80 is placed against the tile, the magnet 74 in the tile will attract the metal stud 84 and keep the figurine suspended and attached at a distance from the magnetic tile 10. The figurine 80 is just an example, as that figurine can be a girl figurine or an animal figurine, for example, a horse, duck or any shape or even a ball the like, or any three dimensional small rendition of a plaything that a child would enjoy placing and holding against the tile. The figurine will not slide, even though it is vertically oriented because the indentation 74 in the tile wall will not allow it to slide down. A second support stud 84*a* can be provided on a large figurine, the studs 84, 84*a* being spaced 7.5 cm apart so the figurine is held by two tiles. In an alternative embodiment, the extension 82 and bead 84 can be formed as a unit 83 that is separable from the figurines 80, with the distal free end 83*a* of the extension 82 providing, for example, a snap-in connection 83*b* in a receiving opening in the figurine 80, or a tongue/groove connection, or a screw-in connection to the figurine 80, so that the extension and bead unit can be used with different figurines. Further, the extension unit 83 may have a friction held pivot 85 built therein so it can be bent at an angle and come in a set of different length extensions, to increase the versatility and diversity of possible play, enabling orienting the figurine 80 in 3-dimensional space. See FIG. 8*a*.

FIG. 9 illustrates artwork or the like that comprises another accessory that will enhance the playing pleasure of the construction set or kit in accordance with the present invention. In FIG. 9, a very thin body artwork piece 90, which can be a painting or drawing prepared on an interior sheet 92 on which is painted a sun, clouds or a child represented by reference number 94, is surrounded by a border 96 that is sprinkled with or contains ferromagnetic material, for example, metal shavings, in sufficient quantity, so that when placed against any of the tiles the drawing, will adhere to the tile magnetically. Thus, after a child creates a particular structure with the magnetic tiles, the child can apply these art sheets to decorate the outer (or inner) surfaces of the structure. The sheet 92 features pre-drawn art. In another embodiment of the invention, the sheet is merely a plastic on which a child can draw its own artwork, in permanent or, optionally, erasable ink, so the child can constantly change the artwork. The size of these sheets can match the smallest of the magnetic tiles or be much larger and simultaneously cover, say, nine tiles. The options are so that the piece 90 can be made in any shape; whether square, rectangular, round or any shapes, as long the metallic border 96 will be near any of the magnets and adhere to the tile surface. This artwork can be applied on the outside, on the inside or on the interior structures within an outer structure made of the magnetic tiles.

Referring to FIG. 10, in accordance with another inventive concept, the invention provides a tile corner stabilizer 102, preferably comprising a first tab 104*a*, a second tab 104*b*, that are connected or joined to each other by either a loose or rigid wire 106 which has a diameter of a millimeter or so, so as to easily fit in the interstitial spaces between four tiles at the point where the four tiles meet each other. This is because tiles 10 have slightly rounded corners. The distance 108 between the two tabs is precisely controlled to be about the 7 mm thickness of the standard tile. When placed at those corner locations, the tendency of tiles to buckle, whether along a vertical or horizontal joint line is very substantially minimized. While the tabs 104*a*, 104*b* are shown to be circular, they can be in any shape, for example, square-shaped or rectangularly shaped, but are preferably made of a transparent rigid plastic material, namely a very hard plastic. They need to reach beyond their center at a distance of about a centimeter or so in the horizontal and vertical directions. Naturally, the larger the size, the stronger the effect. The thickness of each of the tabs can be quite small, and if made of metal, less than one millimeter in thickness.

Turning to FIGS. 11*a* and 11*b*, in a modified form of FIG. 10, the anti-buckling tabs 112 including a first plate 114*a* and a second plate 114*b* that are spaced at a distance 118 from each other, which exactly matches the thickness of a tile. The two plates are joined by a wire or thin web 116 (see FIG. 11*b*) that joins the tabs to each other. When the lower half of 112 is placed onto adjacent tiles, the two tiles located above will naturally be joined at an angle at which the upper half of the tab is provided relative to the lower half. Thereby, one can provide the structure 112 at several different angles, including at a straight angle as well (at 180°), to perform the function of the device of FIG. 10. One can obtain a vertical tile row and atop thereof, a row of tiles that are angled away from the vertical, for example, at 30° to the vertical. The possibilities for play are endless and various structure shapes can be obtained to the great joy and pleasure of a person provided with the accessories of the present invention.

In accordance with a further embodiment that is intended to increase the versatility and playing pleasure of individuals, the invention provides, as shown in FIG. 12, a low voltage generator system 1210 comprising an AC plug 1212 with AC prongs 1214 which can be inserted into an AC socket and have an electrical cord 1216 to provide AC power to a converter 1218 that produces DC voltages of less than 5 volts at ports 1220, the overall converter being provided in a body 1222. A child would have that housing 1222 available and then utilize extension cords, such as shown in FIGS. 12*a* and 12*b* and string as many of the cords as necessary and run them inside a house or any structure built with the tiles of the present invention. These cords comprise a plug 1226 with a male insert 1228 that fits into any of the low voltage sockets 1220 and provides an output plug 1230 with a similar socket 1232. An intermediate socket is provided at 1234.

In FIG. 12*c*, an LED light 1240 which may run on 3.7 volts DC, can provide a white light that shines through a transparent casing 1242, which can be just a clear lens or a lens with a filter; for example, to produce blue or red or any color light. Although a single LED 1240 is shown, the intention is to provide one or any number of LEDs in any arrangement and to support them on a body 1246 which is generally identical in shape and purpose to the attractive body 84 in FIG. 8, enabling the light 1240 to be attached to any of the tiles at its center, adhering to the magnet thereof.

In FIG. 12*d*, the LED support body 1246 is run through an intermediate metallic body 1252, whereby a hanging lamp is obtained by having the piece 1252 adhere to a tile which is provided in a horizontal orientation, providing a dangling light fixture to the enjoyment of the player.

In FIG. 12*e*, a lamp 1260 with lighting inside has a similar anchoring element with a magnetically attractable base 1262 that can be attached to any of the tiles for the same purpose as noted above. Alternatively, the lighting system may be battery driven, either centrally or individually.

Indeed, the lamp and LED lighting can be provided to run on an internal battery 1255 (FIG. 12*d*) which provides its power through a switch 1253 which is normally open but which closes via pull exerted thereon by a magnetic field, so that the light turns only on when it is connected to a magnetic tile and otherwise remains off. The ferromagnetic bar 1251 allows the holder 1252 to be adhered to the wall. The same mechanism works when there is no battery 1255 and the source of power comes from the plug 1250. In other words, the invention can have self-standing small lights that can be placed anywhere without the need to run electrical wires and the LED lightings gets activated only when it is subjected to a magnetic field, i.e. when attached to the magnetic tiles. Naturally, the internal circuitry within the lamp 1246 could be such that when power is applied, the LED blinks or changes colors owing to the internal inclusion of several differently colored LED bulbs, all in well-known manner.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A game set comprising a plurality of construction pieces, the construction pieces contain either one or more magnets or ferromagnetic material to enable the construction pieces to adhere to each other magnetically, the game set comprising:

a plurality of magnetic tiles where each magnetic tile has three or more peripherally extending peripheral sides and a respective thickness substantially smaller than a respective length of the peripheral sides, and each of the magnetic tiles has one or more magnets embedded therein adjacent the peripheral sides thereof, the magnetic tiles being configured so that adjacently located magnetic tiles contact each other by being magnetically drawn and held adjacent and contacting each other at their peripheral sides along at least one joint line, owing to facing ones of said magnets magnetically attracting each other, thereby enabling said magnetic tiles to form wall sections;

a plurality of thin and elongated holding strips comprising at least in part ferromagnetic material, the elongated holding strips having respective length and width dimensions and respective thickness dimension, the thickness dimension being substantially less than the width dimension and the length dimension being sufficiently long so that the holding strip extends lengthwise over and magnetically adheres to three or more abutting pairs of the magnetic tiles that lie in a common plane and the holding strip adheres to and overlaps the peripheral sides of two adjoined tile pairs along the width of the holding strip, the holding strip is located over said joint line and over magnetically joined edges of the pairs of the abutting magnetic tiles and the width of the holding strips is sufficient to resist forces at the joined edges of the magnetic tiles that tend to bend the tiles away from the common plane of the joined pairs of magnetic tiles.

2. The game set of claim 1, wherein the holding strips have lengths sufficient to extend over the joined edges of at least four of the pairs of the magnetic tiles.

3. The game set of claim 1, wherein the holding strips are constructed so they can extend in vertical or horizontal directions over a vertical wall constructed of the magnetic tiles.

4. The game set of claim 1, including a plurality of figurines that have a connection structure containing either magnets or ferromagnetic material and constructed so as to enable the figurines to be magnetically secured to the magnetic tiles.

5. The game set of claim 4, wherein the magnetic tiles include embedded magnets, at a location thereof away from the peripheral sides of the magnetic tiles, to which the figurines are configured can be magnetically attached.

6. The game set of claim 5, wherein the location has a recess where the connection structure of the figurines can be received inside the recess, to prevent downward sliding of the figurines.

7. The game set of claim 1, including vertically extending roof supporting beams for being placed within a chamber formed with the magnetic tiles, to support a roof structure over the chamber.

8. The game set of claim 1, including, in addition to the plurality of holding strips, at least one angled holding strip comprising two joined supporting strips extending in two planes angled relative to each other.

9. The game set of claim 1, wherein the magnetic tiles include, at corner regions thereof, through going eyelets into which a thin pin is insertable.

10. A game set comprising a plurality of construction pieces, the construction pieces contain either one or more magnets or ferromagnetic material to enable the construction pieces to adhere to each other magnetically, the game set comprising:

a plurality of magnetic tiles where each magnetic tile has three or more peripherally extending peripheral sides and a respective thickness substantially smaller than a respective length of the peripheral sides, and each of the magnetic tiles has one or more magnets embedded therein adjacent the peripheral sides thereof, the magnetic tiles being configured to adhere magnetically to each other at their peripheral sides; and a plurality of thin, holding strips constructed at least in part of ferromagnetic material, the holding strips having respective length and width dimensions and respective thickness dimensions, the thickness dimension being less than 2 millimeters and the length dimension being sufficiently long to enable the holding strip to extend over and magnetically adhere to more than at least two, adjoining pairs of the magnetic tiles that lie in a common plane, by being placed over magnetically joined edges of the pairs of the magnetic tiles and the width of the holding strips being sufficient to resist forces at the joined edges of the magnetic tiles that tend to bend the tiles away from the common plane of the joined pairs of magnetic tiles, wherein the magnetic tiles include, at corner regions thereof, through going eyelets into which a thin pin is insertable, and wherein the holding strips contain fingers that fit within the eyelets of the magnetic tiles to provide additional sturdiness to wall structures made of the magnetic tiles, via the holding strips.

11. A game set comprising a plurality of construction pieces, the construction pieces contain either one or more magnets or ferromagnetic material to enable the construction pieces to adhere to each other magnetically, the game set comprising:

a plurality of magnetic tiles where each magnetic tile has three or more peripherally extending peripheral sides and a respective thickness substantially smaller than a respective length of the peripheral sides, and each of the magnetic tiles has one or more magnets embedded therein adjacent the peripheral sides thereof, the magnetic tiles being configured to adhere magnetically to and contact each other at their peripheral sides along joint lines; and a plurality of thin, holding strips constructed at least in part of ferromagnetic material, the holding strips having respective length and width dimensions and respective thickness dimensions, the thickness dimension being less than 2 millimeters and the length dimension being sufficiently long to enable the holding strip to extend over and magnetically adhere to more than at least two, adjoining pairs of the magnetic tiles that lie in a common plane, by being placed over magnetically joined edges of the pairs of the magnetic tiles, each of the holding strips extending over a selected one of said joint lines and the width of the holding strips being sufficient to resist forces at the joined edges of the magnetic tiles that tend to bend the tiles away from the common plane of the joined pairs of magnetic tiles, including a plurality of electrical lights that are configured to be attached to wall structures formed of the magnetic tiles and to be magnetically held to the wall structures.

12. The game set of claim 1, including a drawing sheet that comprises a thin drawing surface surrounded by a border and is large enough to be placed over a tile wall comprising a 2×2 matrix of tiles, the drawing sheet being magnetically attachable to the tile wall and being configured to allow a player to draw on said drawing surface.

* * * * *